US006498905B1

(12) United States Patent
Tsuruya

(10) Patent No.: US 6,498,905 B1
(45) Date of Patent: Dec. 24, 2002

(54) IMAGE FORMING CARTRIDGE SET-UP AND CONTROL

(75) Inventor: Satoshi Tsuruya, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/654,887

(22) Filed: Sep. 5, 2000

(30) Foreign Application Priority Data

Sep. 9, 1999 (JP) ..... 11-256393

(51) Int. Cl.[7] ..... G03G 15/08
(52) U.S. Cl. ..... 399/12; 399/13; 399/223
(58) Field of Search ..... 399/12, 13, 27–29, 399/25, 54, 223, 262

(56) References Cited

U.S. PATENT DOCUMENTS 4,961,088 A 10/1990 Gilliland et al.
5,218,407 A * 6/1993 Matsushita et al. ..... 399/29
5,835,817 A 11/1998 Bullock et al. ..... 399/25

* cited by examiner

*Primary Examiner*—William J. Royer
(74) *Attorney, Agent, or Firm*—Fitzpatrick, Cella, Harper & Scinto

(57) ABSTRACT

An image forming apparatus includes a plurality of cartridges each having a toner container and a memory. The plurality of cartridges are detachably mountable to a main body of the image forming apparatus. A plurality of supply systems supply toners to the respective toner containers of the plurality of cartridges. A control system writes information in the respective memories of the plurality of cartridges. When a new cartridge is mounted, the control system writes color information corresponding to a mounting position in the memory of the new cartridge.

10 Claims, 7 Drawing Sheets

IMAGE FORMING CARTRIDGE SET-UP AND CONTROL

BACKGROUND OF THE INVENTION

1. Field of the Invention

The present invention relates to an image forming apparatus of, for example, electrophotographic type such as a copying machine or a laser printer, and more particularly, it relates to an image forming apparatus capable of forming a color image on a recording material, and a cartridge detachably attachable to such an image forming apparatus.

2. Related Background Art

For example, as one of color image forming apparatuses, there is an image forming apparatus of four-drum multi transfer type (referred to as "in-line color printer" hereinafter) in which a plurality of photosensitive drums as a plurality of electrophotographic photosensitive members are disposed side by side along a conveying direction of a transfer material, developing means such as developing devices containing different color toner are opposed to the respective photosensitive drums, and a full-color image constituted by four color toners is formed on the transfer material conveyed by means of a transfer belt and the like by successively transferring different color toner images formed on the photosensitive drums and developed by the developing means onto the transfer material.

This system can obtain a print image at a higher speed in comparison with an image forming apparatus of type in which different color toner images are successively transferred onto an intermediate transfer member in a superimposed fashion by using a single photosensitive drum and then the toner images are collectively transferred onto a transfer material.

FIG. 6 shows an example of such an in-line color printer. In FIG. 6, an endless transfer belt 6 is mounted on drive rollers 7 and is rotated in a direction shown by the arrow. Along a transfer material conveying direction of the transfer belt 6, there are provided image forming portions Y, M, C and Bk for yellow Y, magenta M, cyan C and Black Bk disposed side by side.

The image forming portions Y, M, C and Bk have similar constructions and include photosensitive drums 1*a*, 1*b*, 1*c*, 1*d* arranged in series along the transfer material conveying direction of the transfer belt 6, charging rollers 2*a*, 2*b*, 2*c*, 2*d* as contact type charging means, developing means 4*a*, 4*b*, 4*c*, 4*d* and cleaning means 5*a*, 5*b*, 5*c*, 5*d*, which means are located around the respective photosensitive drums.

Now, an image forming operation will be described. Laser beams 3*a*, 3*b*, 3*c*, 3*d* modulated in accordance with image data from a host computer such as a personal computer are illuminated onto surfaces of the photosensitive drums 1*a*, 1*b*, 1*c*, 1*d* uniformly charged by the charging rollers 2*a*, 2*b*, 2*c*, 2*d*, thereby obtaining desired electrostatic latent images. These latent images are visualized as toner images by reversal developing at respective developing areas effected by the developing means 4*a*, 4*b*, 4*c*, 4*d* as the developing devices containing the different color toners. The toner images are electrostatically transferred onto a transfer material P fed by sheet feeding means (not shown) and conveyed by the transfer belt 6 under the action of transfer means 8*a*, 8*b*, 8*c*, 8*d* at respective transfer nip portions. Further, after the transferring, non-transferred residual toners remaining on the photosensitive drums 1*a*, 1*b*, 1*c*, 1*d* are removed by the cleaning means 5*a*, 5*b*, 5*c*, 5*d* such as cleaning blade, respectively, for preparation for next image formation.

In the image forming apparatus according to this example, the photosensitive drums 1*a*, 1*b*, 1*c*, 1*d*, charging rollers 2*a*, 2*b*, 2*c*, 2*d*, developing means 4*a*, 4*b*, 4*c*, 4*d* and cleaning means 5*a*, 5*b*, 5*c*, 5*d* are integrally incorporated in cartridge units, respectively, to obtain process cartridges (CRG) 9*a*, 9*b*, 9*c*, 9*d* as shown in FIG. 7. Incidentally, FIG. 7 shows a process cartridge 9*a* for yellow color including toner supplying means 20*a* for supplying toner into the developing means or developing device 4*a*. The toner supplying means 20*a* comprise a toner container 21*a* containing toner to be supplied, and a toner supplying mechanism 22*a* for feeding the toner to the developing device 4*a*.

In FIG. 7, the toner container 21*a* containing the yellow toner is connected to the developing device 4*a* through the toner supplying mechanism 22*a* so that, when the fact that an amount of toner in the developing device 4*a* is decreased below a predetermined amount is detected by appropriate detecting means, a predetermined amount of the yellow toner in the toner container 21*a* is supplied into the developing device 4*a* by the toner supplying mechanism 22*a*. Regarding the other colors, the similar arrangements are adopted. Namely, for magenta color toner, cyan color toner and black color toner, there are provided process cartridges 9*b*, 9*c*, 9*d* and toner supplying means 20*b*, 20*c*, 20*d* containing respective toners.

Although various developing systems have been proposed in the past, in the apparatus shown in FIG. 6, any developing system of contact type or non-contact type may be used and one-component toner or two-component toner may be used as toner or developer. As an example, there is a jumping developing method of non-contact type using non-magnetic one-component toner.

The process cartridges 9*a*, 9*b*, 9*c* and 9*d* can be detachably mounted on a main body of the image forming apparatus. Further, the image forming apparatus has means for detecting service lives of the respective cartridges so that, even if the service life of any cartridge is expired, the image forming apparatus can be used continuously by exchanging such a cartridge with a new one by the operator.

In the recent laser printers, in many cases, a process cartridge which does not require maintenance which is exchange of worn part such as photosensitive member or developer difficult to be replaced by the user, waste toner treatment and the like, and which is detachably attachable to the image forming apparatus has been used. For example, various process cartridges such as a developing cartridge obtained by integrally incorporating a container containing toner and developing means, a drum cartridge obtained by integrally incorporating a photosensitive member, charging means and cleaning means and a cartridge obtained by integrally incorporating such a developing cartridge and such a drum cartridge have been proposed.

In these process cartridges, a service life is alarmed in accordance with a worn extent of each part, and each process cartridge can be exchanged by the user himself. Further, since each cartridge is designed to optimize its service life, a good image having no inconvenience can always be obtained until the service life of the cartridge is expired, and the operator can easily exchange the expired cartridge to a new one.

However, in the image forming apparatus as shown in FIG. 6, when the user firstly mounts the process cartridge to the image forming apparatus after he bought it, it is required that four process cartridges for respective colors Y, M, C, Bk be mounted to predetermined positions. Further, when the service life of any process cartridge is approached, if a corresponding new process cartridge is not prepared, upon expiration of the process cartridge, the image forming apparatus cannot be further used.

As mentioned above, although the advantage that any expert is not required by using the cartridge in the electrophotographic apparatus can be obtained, in the color image forming apparatus, at least four additional process cartridges for respective colors must be previously prepared. Normally, the service lives of the four color process cartridges are rarely expired simultaneously, and, thus, continual preparation of four kinds of process cartridges burdens the user with high expense. Particularly, for the user who operates and controls a plurality of apparatuses, since the storing condition of the respective color cartridges must be ascertained in accordance with the operating condition, inconvenience is increased.

On the other hand, makers for manufacturing the process cartridges perform manufacturing control such as sorting the cartridges for respective colors and production adjustment, and, thus, the makers are burdened with great load in the process cartridges for the color image forming apparatus. In general, the developing devices for respective colors are designed to have no difference in construction in order to reduce the cost by using the identical parts.

However, even when designed in this way, nowadays, in order to prevent user from erroneous mounting, specifications of process cartridges are made to be different from each other. For example, configurations of the cartridge containers for respective colors have been partly changed, seals identifying particular colors have been adhered to the cartridges for respective colors or colors of packages for the respective color cartridges have been changed. Thus, the number of parts are increased to increase the cost in comparison with the case where the identical process cartridges are manufactured.

SUMMARY OF THE INVENTION

The present invention aims to eliminate the above-mentioned conventional drawbacks, and an object of the present invention is to provide an image forming apparatus which can reduce the burden of the users and/or makers, and a cartridge detachably attachable to such an image forming apparatus.

Another object of the present invention is to provide an image forming apparatus having low cost, and a cartridge detachably attachable to such an image forming apparatus.

A further object of the present invention is to provide an image forming apparatus comprising a plurality of cartridges each having a toner container and a memory and detachably attachable to a main body of the image forming apparatus, a plurality of supplying means for supplying toners to the respective toner containers, and a plurality of writing means for writing information in the respective memories, and wherein, when a new cartridge is mounted, the writing means write color information corresponding to a mounting position in the memory.

The other object of the present invention is to provide a cartridge comprising a toner container and a memory, and wherein, in a condition that the cartridge is never mounted to an apparatus, the toner container is empty.

The other objects and features of the present invention will be apparent from the following detailed explanation of the invention referring to the accompanying drawings.

DETAILED DESCRIPTION OF THE PREFERRED EMBODIMENTS

Now, an image forming apparatus according to the present invention will be fully explained with reference to the accompanying drawings. Incidentally, since a construction of a main body of the image forming apparatus and an imaging process thereof are the same as those of the image forming apparatus shown in FIG. 6, explanation of the entire construction and function of the image forming apparatus will be omitted, and only characteristic portions of the present invention will be described.

First Embodiment

Figure 1:
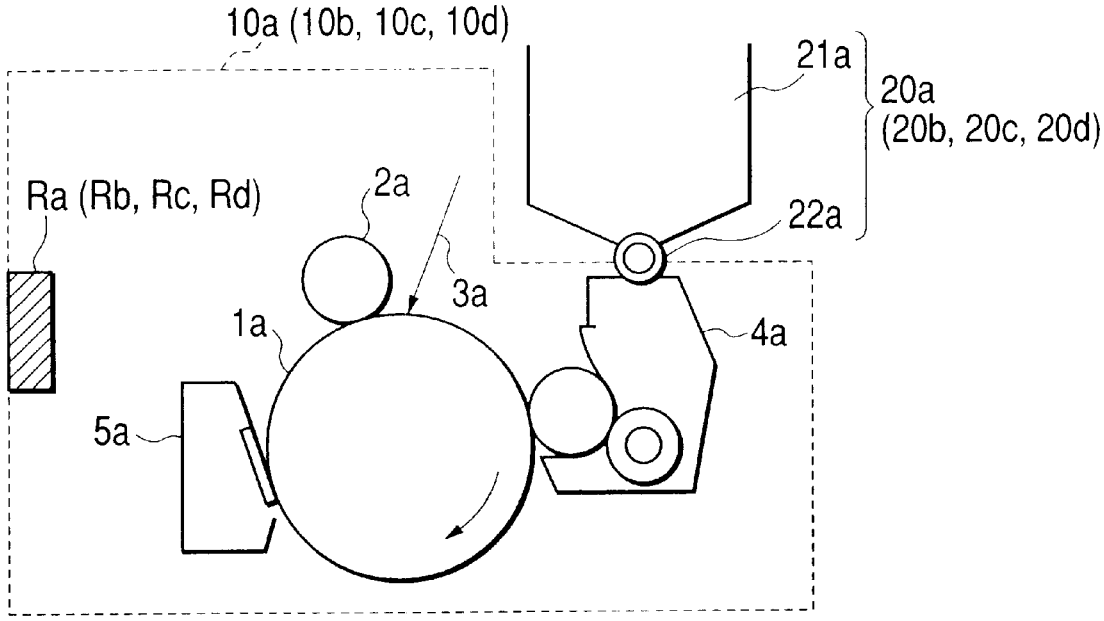
FIG. 1 is a constructural view showing a process cartridge according to a first embodiment of the present invention.
Figure 2:
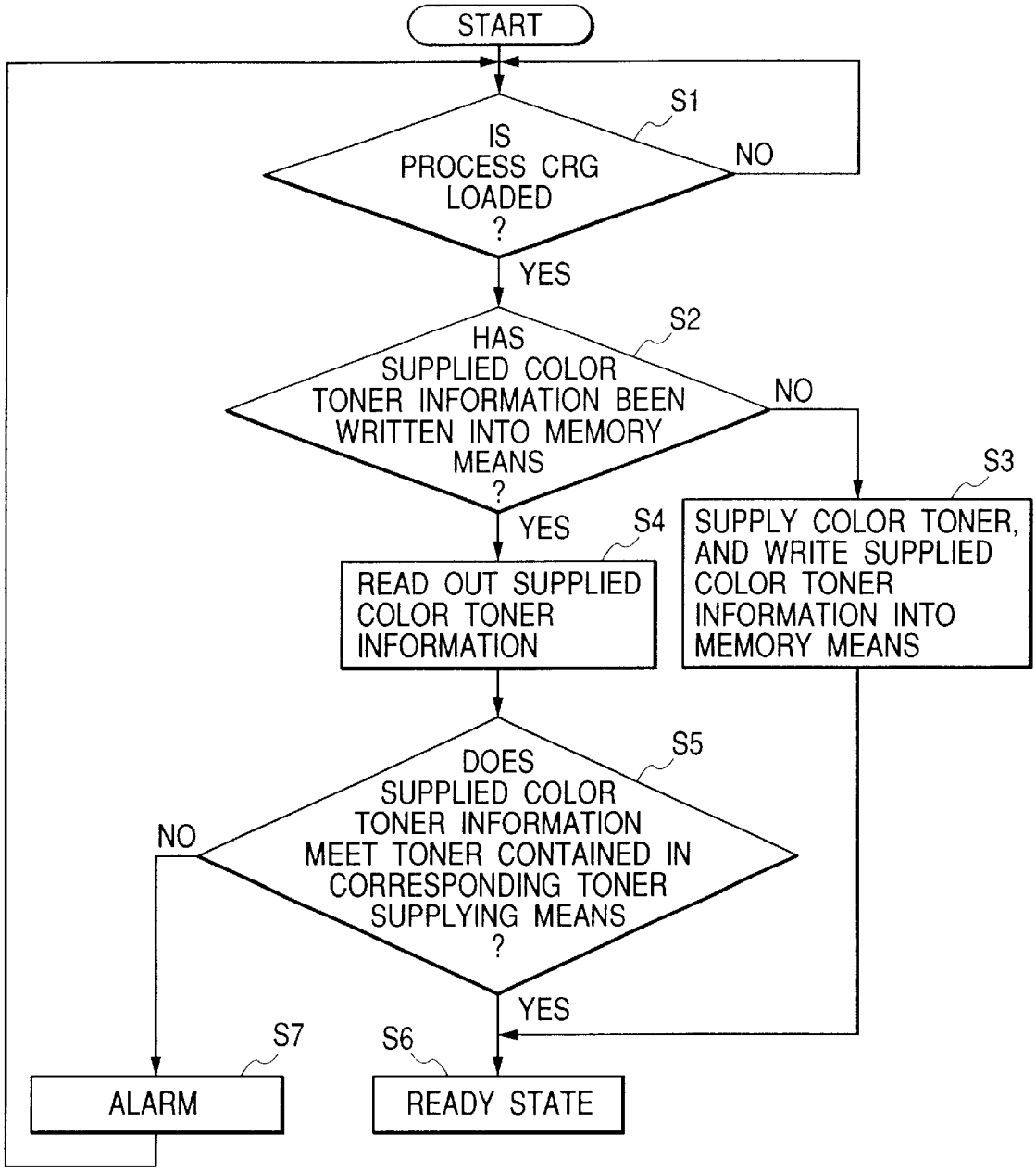
FIG. 2 is a flow chart showing a control flow according to the first embodiment.

A first embodiment of the present invention will be described with reference to FIGS. 1 and 2. FIG. 1 is a constructural view showing process cartridges 10*a*, 10*b*, 10*c*, 10*d* according to the first embodiment, and the process cartridges 10*a* to 10*d* are detachably attachable to the in-line color printer as the conventional image forming apparatus shown in FIG. 6.

Figure 7:
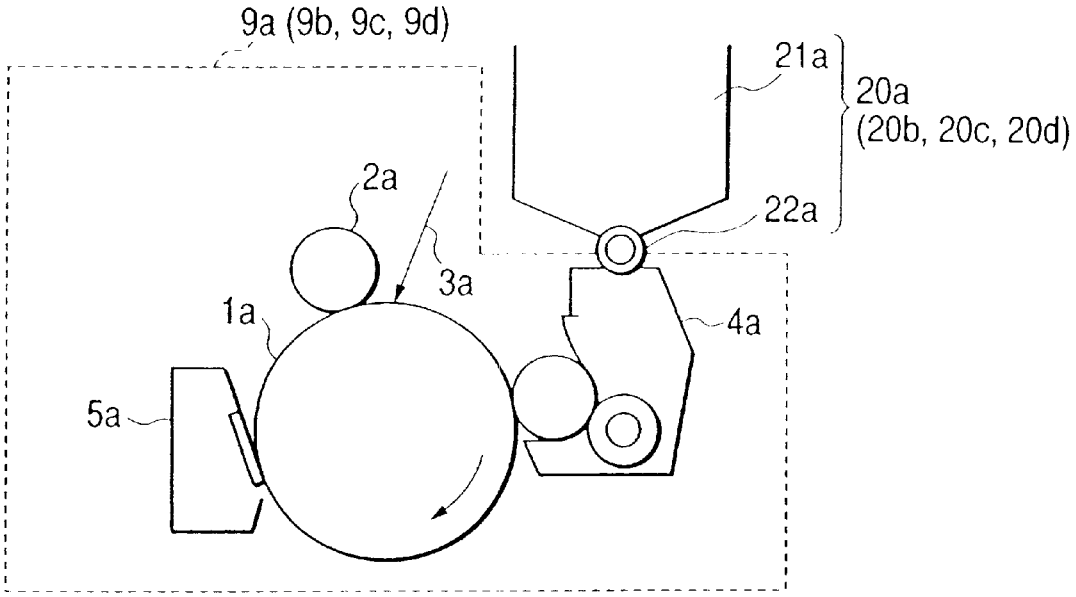
FIG. 7 PRIOR ART
FIG. 7 is a constructural view showing a conventional process cartridge.

Different from the process cartridges 9*a* to 9*d* shown in FIG. 7, the process cartridges 10*a* to 10*d* for yellow (Y), magenta (M), cyan (C) and black (Bk) colors are provided with non-volatile read/write memory means Ra, Rb, Rc, Rd such as EEPROMs which are electrically connected to a main body of the image forming apparatus through connectors (not shown) to permit communication of information between the memories and a control portion of the main body. Further, in a condition that the process cartridge is never mounted to the main body of the apparatus, there is no toner in a container 4*a*. Regarding the memory means Ra to Rd, information can be read and written by the control portion. As the memory means, read/write non-contact memories of electromagnetic coupling type capable of sending and receiving a signal in a non-contact condition may be used.

Now, preparation in which the process cartridges 10*a* to 10*d* are firstly mounted to the main body of the apparatus will be firstly explained.

Although the process cartridges 10*a* to 10*d* are mounted to four positions corresponding to toner supplying means 20*a* to 20*d* for Y, M, C, Bk color toners within the main body of the apparatus, since the process cartridges 10*a* to 10*d* for respective colors according to the illustrated embodiment are common, the process cartridges are not mounted to the particular positions corresponding to the particular colors, but may be merely mounted without consideration of color.

When the control portion of the main body of the image forming apparatus detects the fact that the process cartridges

10*a* to 10*d* are mounted to the main body, the control portion writes information regarding the color of the toner which has been supplied in the initiation of usage, into the memory means Ra to Rd of the process cartridges 10*a* to 10*d*, thereby preparing for an image forming operation ("Ready" condition).

Incidentally, as means for storing the information regarding the color of the toner which has been supplied, other than the aforementioned memories, electrical or mechanical storing means may be provided. For example, four fuses or resistance elements may be provided on the process cartridge and the fuse or the resistance element corresponding to the position where the toner was firstly supplied may be broken, which fact may be detected by the control portion. Alternatively, several protruded portions may be provided on the process cartridge and the protruded portion corresponding to the position where the toner was firstly supplied may be bent from the main body side, which fact may be detected by the control portion by using an optical sensor and the like. Namely, means for continuously storing the color of toner firstly supplied in the initiation of usage of the process cartridge may be provided, and, thereafter, such color may be discriminated by the control portion.

Next, control for preventing operator's erroneous mounting of the process cartridge in the normal usage will be described.

The color toner information stored in the memory means Ra to Rd is read out by the control portion at a timing in which there is the possibility of mounting or dismounting of the process cartridges 10*a* to 10*d*, i.e., at a timing when the fact that the process cartridges 10*a* to 10*d* are mounted or dismounted is detected or when a power supply switch of the main body is turned ON/OFF, and, after the fact that the color toner contained in the toner supplying means 20*a* to 20*d* corresponding to the presently mounted position is coincided with the color toner information stored in the memory means is ascertained, the image forming operation is started. On the other hand, if not coincided, the image forming apparatus is not operated to prevent the different color toner from entering into the developing device, and the fact that the mounting positions of the process cartridges 10*a* to 10*d* are wrong is alarmed on a display portion of the image forming apparatus.

Further explanation will be made with reference to the flow chart shown in FIG. 2.

First of all, when the fact that the process cartridges 10*a* to 10*d* are mounted to the main body of the in-line color printer in the waiting condition is detected (step S1), the control portion ascertains whether the supplied color toner information has already been written in the memory means Ra to Rd or not (step S2). If not written, i.e., if the process cartridges are new, predetermined amount of toners having colors corresponding to the mounted positions are supplied into the developing devices of such process cartridges by toner supplying means. At the same time when the supplying operation is started, the control portion writes the data regarding the supplied toner colors in the memory means of the process cartridges (step S3), thereby establishing a ready state in which the image forming operation can be started in response to print request from a host computer (step S6).

On the other hand, in the step S2, if the supplied color toner information has already been written in the memory means Ra to Rd, the control portion reads out the color toner information written in the memory means R (step S4) and ascertains whether the color toner contained in the toner supplying means 20*a* to 20*d* corresponding to the presently mounted position is coincided with the color toner information stored in the memory means (step S5). If coincided, the ready state is established (step S6). On the other hand, if not coincided, the control portion does not establish the ready state, and the fact that the mounting positions of the process cartridges 10*a* to 10*d* are wrong is alarmed on the display portion of the image forming apparatus or on the connected host computer via a printer driver or the like (step S7).

When the process cartridges are re-mounted in accordance with the alarming, the processing from the step S1 is performed. Incidentally, when one of the process cartridges is exchanged to a new one due to expiration of the service life thereof, the same processing is performed.

With the arrangement as mentioned above, even if the user erroneously mounts the process cartridges, the correct re-mounting is demanded to the user, and various image troubles due to color mixing can be prevented. By providing a new cartridge having the empty container and the memory, the process cartridges for various colors can be made common.

Accordingly, as mentioned above, the user does not require to prepare and control the process cartridges for respective colors and merely exchanges the expired cartridge to a new one without consideration of color, thereby reducing the user's burden.

On the other hand, since the maker may merely manufacture identical process cartridges for various colors, the manufacturing and controlling costs can be reduced.

Second Embodiment

Figure 4:
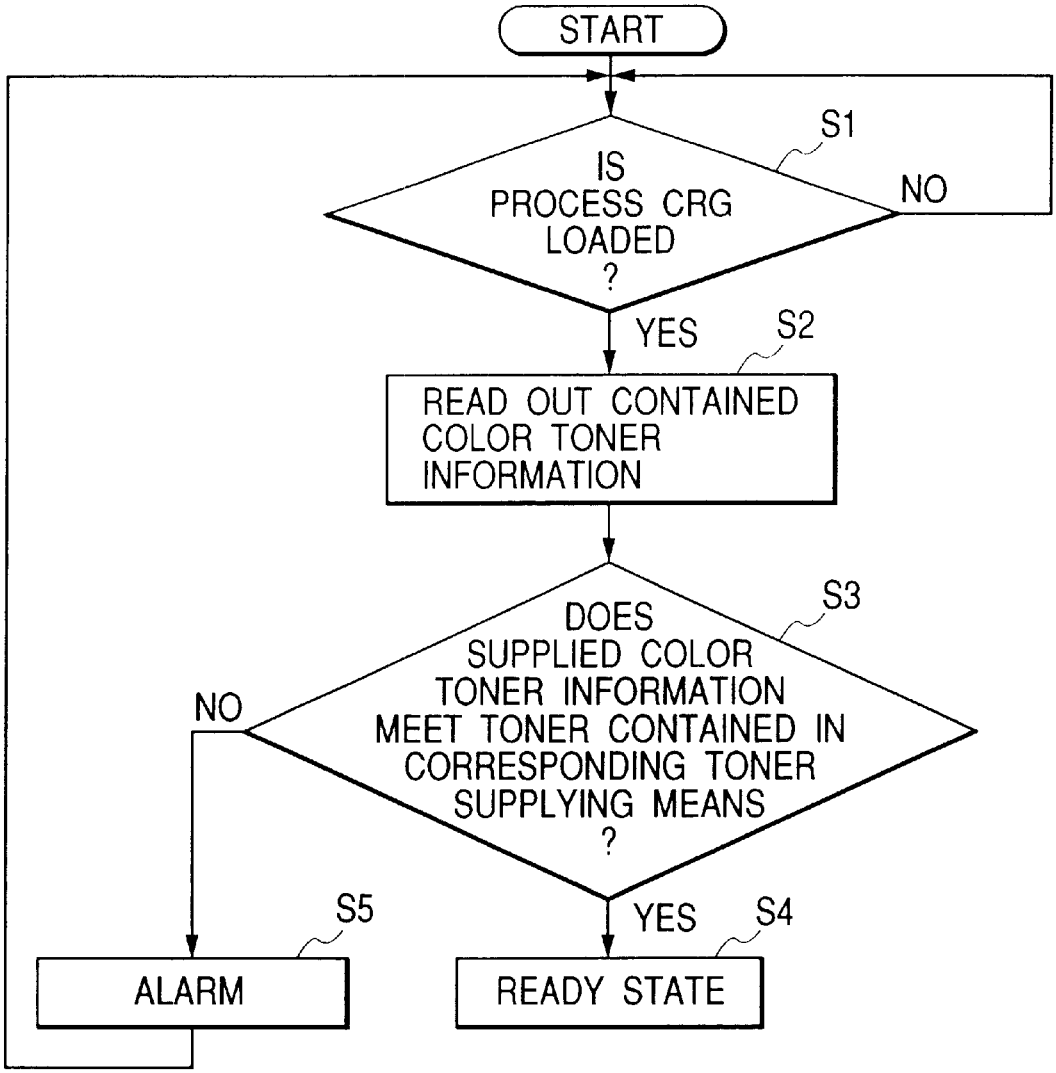
FIG. 4 is a flow chart according to the second embodiment and showing a control flow in a case where arranging order of the process cartridge and the toner cartridge is previously determined.
Figure 5:
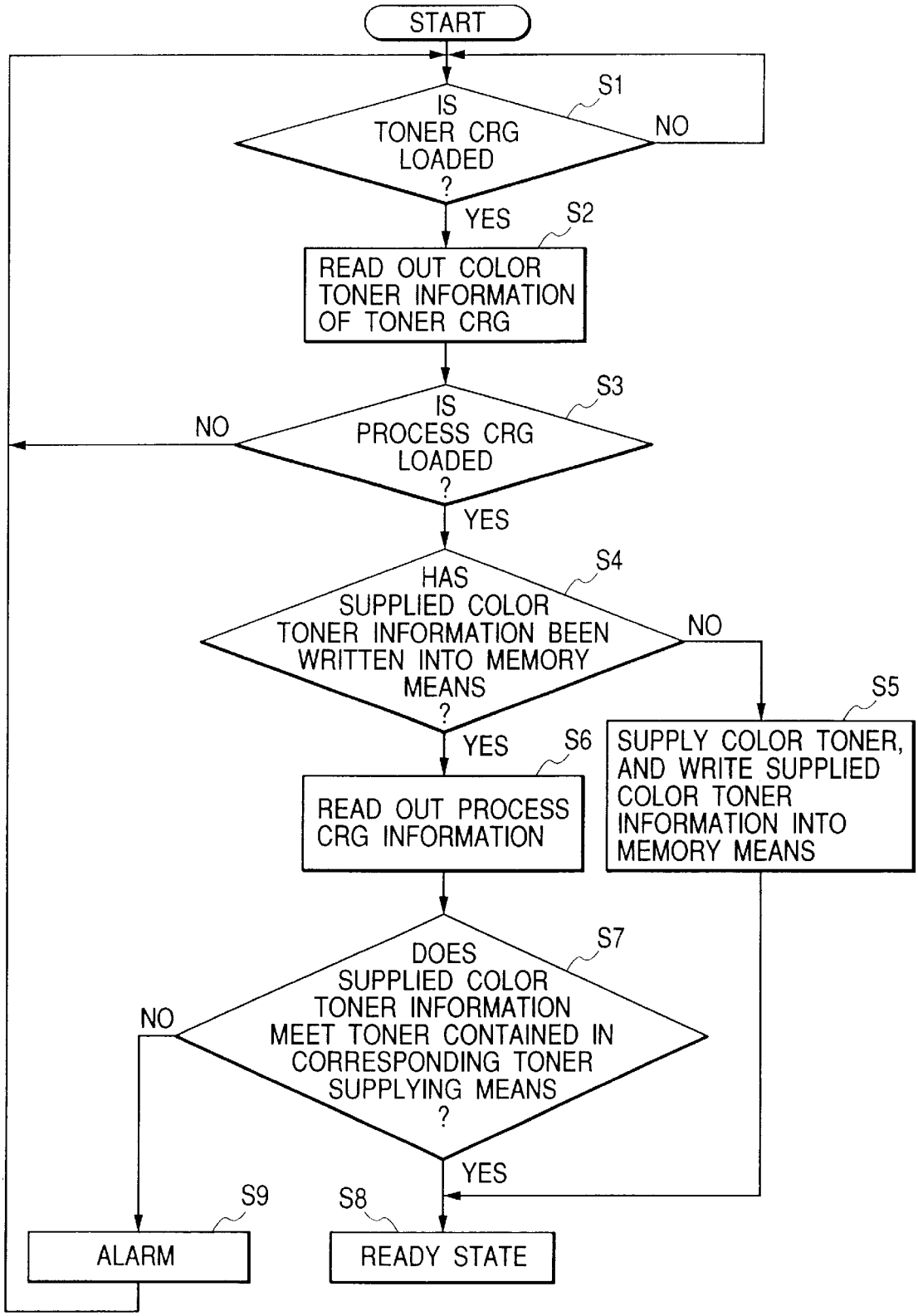
FIG. 5 is a flow chart according to the second embodiment and showing a control flow in a case where arranging order of the process cartridge and the toner cartridge is not previously determined.

Next, a second embodiment of the present invention will be explained with reference to FIGS. 3 to 5.

Figure 3:
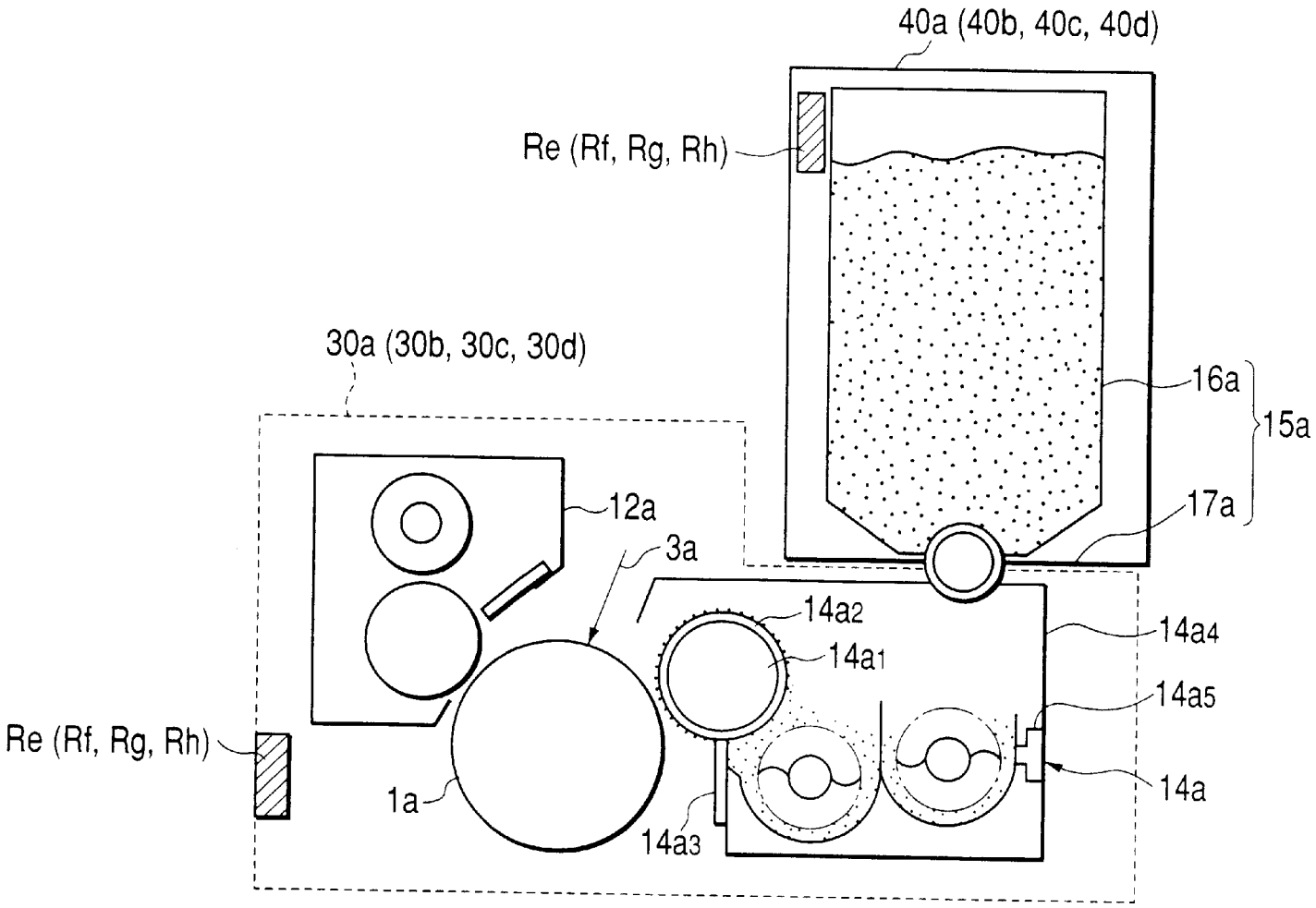
FIG. 3 is a constructural view showing a process cartridge and a toner cartridge according to a second embodiment of the present invention.

FIG. 3, is an explanatory view showing process cartridges 30*a*, 30*b*, 30*c*, 30*d* and toner cartridges 40*a*, 40*b*, 40*c*, 40*d* according to a second embodiment of the present invention. Both cartridges can detachably be mounted on an in-line color printer as an image forming apparatus shown in FIG. 6. Incidentally, for the purpose for simplifying the explanation, FIG. 3 shows a case of yellow toner, but, the other color toners are the same.

As a point that the process cartridge 30*a* according to the illustrated embodiment differs from the first embodiment, a magnet brush charging device 12*a* utilizing conductive magnetic particles is used as charging means, so that an injection charging system for directly injecting charges to the photosensitive member is adopted. Further, a developing device 14*a* of a two-component contact type is used as developing means so that a thin layer of developer comprised of a magnetic carrier and non-magnetic toner is formed on a developing sleeve 14*a*2 including therein a magnet roller 14*a*1 by means of a blade 14*a*3. By applying a predetermined bias at a developing station, an electrostatic latent image is formed.

The developing device 14*a* is provided with an inductance sensor 14*a*5 as toner density detecting means so that a ratio (toner density) between the toner and the carrier is detected by measuring permeability of the developer. If the toner density is decreased below a predetermined value, a predetermined amount of toner in a toner container 16*a* is supplied to the developing device 14*a* by a supplying mechanism 17*a*.

The process cartridge 30*a* (30*b* to 30*d*) does not have the cleaning means shown in FIG. 1, but, a so-called cleanerless system in which the residual toner on the photosensitive member is collected into the developing device 14*a* by difference in potential between the surface of the photosensitive member and bias applied to the developing sleeve 14*a*2 for re-use is adopted. By adopting such a system, the apparatus can be made more compact.

In the illustrated embodiment, the toner container containing the toner is designed as a toner cartridge detachably mountable on the main body of the apparatus, and the toner cartridge is provided with memory means.

Data regarding the color toner contained is written in the memory means Re of the yellow (Y) toner cartridge 40*a* shown in FIG. 3 and the memory means is electrically connected to the main body so that the color of the toner contained in the toner cartridge 40*a* mounted at. that position can be discriminated by the control portion.

The toner cartridges 40*a*, 40*b*, 40*c*, 40*d* for Y, M, C and Bk colors are provided with memory means Re, Rf, Rg, Rh, respectively so that the color of the toner contained in the toner cartridge mounted to the main body of the image forming apparatus can be discriminated by the control portion. ROMs for only reading may be used as the memory means Re to Rh.

Figure 6:
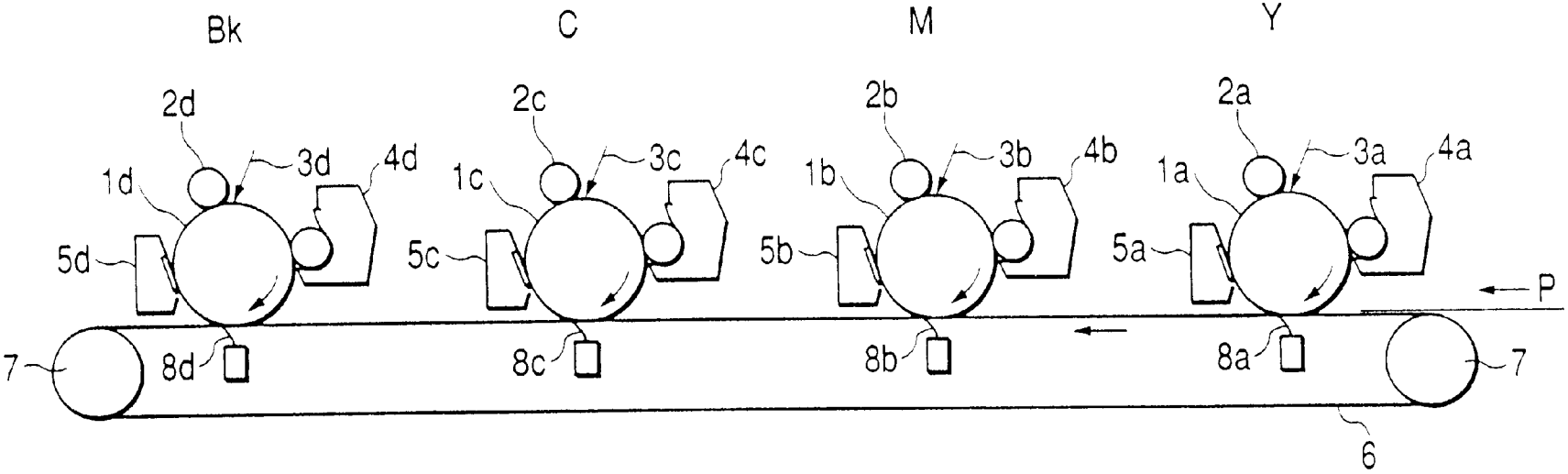
FIG. 6 PRIOR ART
FIG. 6 is a constructural view showing a color image forming apparatus associated with an embodiment of the present invention and a prior art.

In the first embodiment, while an example that the images are formed in the order Y, M, C, Bk in the apparatus of FIG. 6 was explained, in the second embodiment, upon image formation, there is a case-where the order of color image formation is predetermined and a case where the forming order of the color images is voluntary. These cases will now be described.

First of all, as in the first embodiment, in the case where the images are formed in the order Y, M, C and Bk, when the toner cartridges 40*a* to 40*d* are mounted to the main body, the control portion ascertains whether the color information read out from the memory means Re to Rh of the cartridges 40*a* to 40*d* coincide with the positions where the toner cartridges 40*a* to 40*d* are mounted, i.e., ascertains whether the cartridges are located at the corresponding color positions.

Further explanation will be made with reference to the flow chart shown in FIG. 4.

First of all, when the fact that the toner cartridges 40*a* to 40*d* are mounted to the main body of the in-line color printer in the waiting condition is detected (step S1), the control portion reads out the color toner information written in the memory means Re to Rh (step S2). It is ascertained whether the read-out toner colors coincide with the presently mounted positions or not (step S3). If the colors coincide, a ready state can be established in response to a print request from a host computer (step S4). On the other hand, if the colors do not coincide, the control portion does not establish the ready state, and the fact that the mounting positions of the toner cartridges 40*a* to 40*d* are wrong is alarmed on the display portion of the image forming apparatus or on the connected host computer (step S5).

As is in the process cartridges according to the first embodiment, the above-mentioned series of operations are performed at a predetermined timing in which there is the possibility of mounting or dismounting of the toner cartridges 40*a* to 40*d*, and, after the fact that the presently mounted positions are coincided with the colors of toners contained in the toner cartridges 40*a* to 40*d* is ascertained, the image forming operation is started.

Incidentally, in a new condition, each of the process cartridges 30*a* to 30*d* contains the carrier (used in development by mixing it with toner) but does not contain the toner.

Next, the case where the image forming order of the Y, M, C and Bk color images is voluntary will be explained.

Now, a case where the toner cartridges 40*a* to 40*d* and the process cartridges 30*a* to 30*d* are mounted to the main body of the image forming apparatus in the initiation of usage will firstly be described.

Although eight cartridges, i.e., toner cartridges 40*a* to 40*d* and process cartridges 30*a* to 30*d* for Y, M, C and Bk colors are mounted to the main body, in the illustrated embodiment, since the color mounting positions are voluntary and the process cartridges 30*a* to 30*d* are common for various colors, the cartridges are not required to be mounted to the predetermined corresponding color positions, but may merely be mounted without consideration of colors.

After all of the cartridges are mounted and this fact is detected, under the control of the control portion, predetermined amounts of respective color toners are supplied into the developing devices 14*a* to 14*d* of the process cartridges 30*a* to 30*d* by the toner supplying means 15*a* to 15*d*. At the same time, when the supplying operation is started, the control portion reads out the color toner information written in the memory means Re to Rh of the toner cartridges 40*a* to 40*d* and writes the supplied colors in the memory means Re to Rh of the process cartridges 30*a* to 30*d*, thereby establishing the ready state in which the image forming operation can be started.

Next, control for preventing erroneous insertion of the toner cartridges 40*a* to 40*d* and the process cartridges 30*a* to 30*d* in the normal usage will be explained.

The color toner informations written in the memory means Re to Rh of the toner cartridges 40*a* to 40*d* and the process cartridges 30*a* to 30*d* are read out by the control portion at the predetermined timing in which there is the possibility of mounting or dismounting of the cartridges. In the control portion, the fact that the color data written in the memory means Re to Rh of the toner cartridges 40*a* to 40*d* corresponding to the presently mounted positions coincide with the color data written in the memory means Re to Rh of the process cartridges 30*a* to 30*d* is ascertained, and, thereafter, the image forming operation is started. If not coincided, the image forming apparatus is not operated, and the fact that the mounting positions of the process cartridges 30*a* to 30*d* or the toner cartridges 40*a* to 40*d* are wrong is alarmed on the display portion of the image forming apparatus.

Further explanation will be made with reference to the flow chart shown in FIG. 5.

First of all, when the fact that the toner cartridges 40*a* to 40*d* are mounted to the main body of the in-line color printer in the waiting condition is detected (step S1), the control portion of the main body reads out the color toner information written in the memory means Re to Rh (step S2).

Then, when the fact that the process cartridges 30*a* to 30*d* are mounted is detected (step S3), the control portion successively ascertains whether the supplied color toner information has already been written in the memory means Re to Rh (step S4). If there is any process cartridge in which the color toner information is not yet written, i.e., regarding a new process cartridge, a predetermined amount of toner having color corresponding to the mounted position is supplied to the developing device of such process cartridge by the toner supplying means. At the same time when the supplying operation is started, the control portion writes the supplied toner color in the memory means of the process cartridge (step S5), thereby establishing the ready state in which the image forming operation can be started in response to the printer request from a host computer (step S8).

On the other hand, if the supplied color toner information has already been written in the memory means Ra to Rd of the process cartridges 30*a* to 30*d*, the control portion reads out the color toner information written in the memory means Ra to Rd of the process cartridges 30*a* to 30*d* (step S6) and ascertains whether the color toner information written in the memory means Ra to Rd of the toner cartridges 40*a* to 40*d* opposed to the presently mounted positions coincide with the color toner information written in the memory means Ra to Rd (step S7). If coincided, the ready condition is established (step S8). On the other hand, if not coincided, the control portion does not establish the ready state, and the fact that the mounting positions of the process cartridges 30*a* to 30*d* are wrong is alarmed on the display portion of the image forming apparatus or on the connected host computer (step S9).

When the process cartridges or the toner cartridges are re-mounted in accordance with the alarming, similar processing from step S1 is performed. Incidentally, when one of the process cartridges or the toner cartridges is exchanged for a new one due to expiration of the service life thereof, the same processing is performed.

As mentioned above, by providing the memory means on the process cartridges, any troubles due to the erroneous mounting can be prevented and the process cartridges for various colors can be made common. Further, also by providing the memory means on the toner cartridges, in the case where the image forming order of the in-line color printer is voluntary, particularly, troublesome of mounting of the cartridges in the installing operation can be reduced.

Incidentally, in the illustrated embodiment, while the image forming apparatus having four-drum multi transfer system was explained, the present invention is not limited to such a system but can be applied to other color image forming apparatuses of type having toner supplying developing devices.

Further, the process cartridge is not limited to the illustrated process cartridge integrally including the photosensitive member, developing means and charging means, but, various kinds of cartridges such as a cartridge including only developing means can be used. That is to say, the same effect can be achieved by providing the memory means on the cartridges of type having the toner supplying developing devices and by applying the present invention explained in connection with the second embodiment.

The present invention is not limited to the above-mentioned embodiments, but various alterations and modifications can be made within the scope of the invention.

What is claimed is:

1. An image forming apparatus comprising:

a plurality of cartridges each having a toner container and a memory, said plurality of cartridges being detachably mountable to a main body of the image forming apparatus;

a plurality of supply systems for supplying toners to the respective toner containers of said plurality of cartridges; and a control system for writing information in the respective memories of said plurality of cartridges, wherein when a new cartridge is mounted, said control system writes color information corresponding to a mounting position in the memory of the new cartridge.

2. An image forming apparatus according to claim 1, wherein said plurality of cartridges have the same configuration.

3. An image forming apparatus according to claim 1, said control system further for inhibiting an image forming operation if at least one of said plurality of cartridges is mounted to a mounting position that does not correspond to color information written in the memory of the at least one of said plurality of cartridges.

4. An image forming apparatus according to claim 1, said control system further for informing of the fact that a mounting position is wrong if at least one of said plurality of cartridges is mounted to a mounting position that does not correspond to color information written in the memory of the at least one of said plurality of cartridges.

5. A cartridge detachably mountable on an image forming apparatus, the image forming apparatus having a plurality of cartridge mounting portions, said cartridge comprising:

a toner container; and a memory, wherein when said cartridge is first mounted to one of the plurality of cartridge mounting portions of the image forming apparatus, color information corresponding to the cartridge mounting portion is memorized in said memory.

6. A cartridge according to claim 5, further comprising an electrophotosensitive member, and at least one of charging means for charging said electrophotosensitive member, developing means for supplying developer to said electrophotosensitive member and cleaning means for cleaning said electrophotosensitive member.

7. An image forming apparatus comprising:

a plurality of a first type of cartridge detachably mountable on a main body of said image forming apparatus, each first type of cartridge having a toner container and a memory for storing color information;

a plurality of a second type of cartridge detachably mountable on the main body of said image forming apparatus, each second type of cartridge having a memory and a toner container containing toner supplied from one of said plurality of the first type of cartridge; and a control system for writing information in the memory of said second type of cartridge, wherein when a new second type of cartridge is mounted, said control system writes color information, which is stored in the memory of one of said plurality of the first type of cartridge corresponding to a mounting position of the new second type of cartridge, into the memory of the new second type of cartridge.

8. An image forming apparatus according to claim 7, wherein the new second type of cartridge is mounted on any one of a plurality of second type of cartridge mounting portions provided on the main body of said image forming apparatus.

9. An image forming apparatus according to claim 7, wherein the toner container of the new second type of cartridge contains no toner.

10. An image forming apparatus according to claim 7, wherein mounting portions for mounting said plurality of the first type of cartridge, each of said plurality of the first type of cartridge corresponding to one of a plurality of colors, are unassigned prior to mounting said plurality of the first type of cartridge on said image forming apparatus for the first time.

* * * * *